US012708829B2

(12) United States Patent
Rimer et al.

(10) Patent No.: US 12,708,829 B2
(45) Date of Patent: Aug. 18, 2026

(54) ESTIMATING GOLFER POSITION USING VEHICLE SENSORS

(71) Applicant: Textron Inc., Providence, RI (US)

(72) Inventors: Shayne Evan Rimer, North Augusta, SC (US); Brian Wanta, North Augusta, SC (US)

(73) Assignee: TEXTRON INNOVATIONS INC., Providence, RI (US)

( * ) Notice: Subject to any disclaimer, the term of this patent is extended or adjusted under 35 U.S.C. 154(b) by 0 days.

(21) Appl. No.: 18/804,863

(22) Filed: Aug. 14, 2024

(65) Prior Publication Data

US 2026/0048316 A1 Feb. 19, 2026

(51) Int. Cl.

| | |
|---|---|
| ***A63B 71/06*** | (2006.01) |
| ***A63B 24/00*** | (2006.01) |
| *A63B 55/60* | (2015.01) |

(52) U.S. Cl.

CPC ..... *A63B 71/0605* (2013.01); *A63B 24/0062* (2013.01); *A63B 71/0622* (2013.01); *A63B 55/61* (2015.10); *A63B 2220/05* (2013.01); *A63B 2220/12* (2013.01); *A63B 2220/20* (2013.01)

(58) Field of Classification Search

CPC . A63B 71/0669; A63B 71/0605; A63B 24/00; A63B 24/0062; A63B 55/61; A63B 2220/05; A63B 2220/12; A63B 2220/20

See application file for complete search history.

(56) References Cited

U.S. PATENT DOCUMENTS

| | | | | |
|---|---|---|---|---|
| 8,460,111 | B2 | 6/2013 | Hart | |
| 9,028,344 | B2 | 5/2015 | Baker et al. | |
| 9,393,478 | B2 * | 7/2016 | Niegowski | A63B 71/0669 |
| 9,661,894 | B2 * | 5/2017 | Niegowski | A63B 37/0003 |
| 10,209,718 | B2 | 2/2019 | Tiwari et al. | |
| 10,232,225 | B1 * | 3/2019 | Oberc | A63B 69/3655 |
| 10,649,451 | B2 | 5/2020 | Doane et al. | |
| 10,984,275 | B1 | 4/2021 | Campbell | |
| 11,000,734 | B2 | 5/2021 | Broadie et al. | |
| 11,079,497 | B2 | 8/2021 | Li et al. | |
| 11,417,098 | B1 | 8/2022 | Campbell | |
| 11,538,218 | B2 | 12/2022 | Prabhakar | |
| 11,720,862 | B2 | 8/2023 | Dagley et al. | |
| 11,729,490 | B2 | 8/2023 | Imes | |

(Continued)

*Primary Examiner* — Steve Rowland
(74) *Attorney, Agent, or Firm* — Foley & Lardner LLP

(57) ABSTRACT

A golf system includes a golf cart, one or more sensors coupled to the golf cart, and one or more processing circuits including one or more memory devices coupled to the one or more processors. The one or more memory devices are configured to store instructions thereon that, when executed by the one or more processors, cause the one or more processors to: determine, based on one or more first signals from the one or more sensors, that a golfer has exited the golf cart, determine, based on one or more second signals from the one or more sensors, a current location of the golf cart, determine, based on one or more third signals from the one or more sensors, a golf stroke of the golfer has occurred, determine a relative position of the golfer during the golf stroke to the current location of the golf cart, and determine a shot position of the golfer based on the relative position of the golfer and the current location of the golf cart.

19 Claims, 5 Drawing Sheets

(56) References Cited

U.S. PATENT DOCUMENTS 11,776,383 B1 10/2023 Nguyen
11,941,915 B2 3/2024 Tyomkin
2007/0263089 A1* 11/2007 Hess ..... A63B 24/0003 348/148
2008/0182685 A1 7/2008 Marty et al.
2009/0017944 A1* 1/2009 Savarese ..... G01S 13/56 473/409
2009/0111602 A1* 4/2009 Savarese ..... G01S 19/19 473/283
2010/0099509 A1* 4/2010 Ahem ..... A63B 71/0669 700/92
2011/0230274 A1* 9/2011 Lafortune ..... A63B 71/0669 473/217
2012/0052971 A1* 3/2012 Bentley ..... A63B 24/0006 473/222
2012/0088544 A1* 4/2012 Bentley ..... A63F 13/332 455/556.1
2012/0295739 A1 11/2012 Young
2014/0347193 A1* 11/2014 Ljung ..... H04L 67/04 340/870.01
2015/0157944 A1* 6/2015 Gottlieb ..... A63F 13/812 463/4
2015/0318015 A1* 11/2015 Bose ..... G08B 21/043 386/248
2016/0317896 A1* 11/2016 Albelo ..... G01S 19/19
2017/0080319 A1 3/2017 Bastawros
2018/0140898 A1* 5/2018 Kasha ..... A63B 71/0622
2019/0232142 A1 8/2019 Doherty et al.
2019/0299058 A1 10/2019 Chan et al.
2019/0384303 A1 12/2019 Muller et al.
2020/0038724 A1 2/2020 Vanlandingham et al.
2020/0078653 A1 3/2020 Leech et al.
2020/0164262 A1 5/2020 Leech
2020/0210777 A1 7/2020 Valois et al.
2020/0262350 A1 8/2020 Takhirov et al.
2021/0049409 A1 2/2021 Klein et al.
2021/0069548 A1* 3/2021 Beach ..... A63B 24/0006
2021/0142595 A1 5/2021 Siddique et al.
2021/0308549 A1 10/2021 Leech
2021/0383124 A1 12/2021 Imes
2022/0129683 A1 4/2022 Levin
2022/0161121 A1 5/2022 Syed et al.
2022/0212081 A1* 7/2022 Kubodera ..... G06V 40/23
2022/0245929 A1 8/2022 Aslandere et al.
2022/0277551 A1 9/2022 Li
2022/0280855 A1 9/2022 Tuxen et al.
2022/0296964 A1 9/2022 Thurner
2022/0357440 A1 11/2022 Hugmark et al.
2023/0032076 A1* 2/2023 Lee ..... G06V 40/23
2023/0070986 A1 3/2023 Okur et al.
2023/0072561 A1 3/2023 Yoon
2023/0085842 A1 3/2023 Hugmark et al.
2023/0094756 A1 3/2023 Chang
2023/0096598 A1 3/2023 Imes
2023/0101793 A1 3/2023 Hixenbaugh et al.
2023/0186493 A1 6/2023 Lee et al.
2023/0242129 A1 8/2023 Xu
2023/0264092 A9 8/2023 Colangelo
2023/0314602 A1 10/2023 Tuerker et al.
2023/0316146 A1 10/2023 Cho et al.
2023/0381625 A1 11/2023 Imes
2023/0390604 A1 12/2023 Hugmark et al.
2023/0405438 A1 12/2023 Lovell et al.
2024/0005659 A1 1/2024 Imes

* cited by examiner

ESTIMATING GOLFER POSITION USING VEHICLE SENSORS

BACKGROUND

Golf vehicles are used to transport personnel and equipment between different areas. By way of example, a golf vehicle may transport golfers and equipment (e.g., golf bags, golf clubs, etc.) around a golf course (e.g., along a cart path, between different holes, etc.).

SUMMARY

One embodiment relates to a golf system. The golf system includes a golf cart, one or more sensors coupled to the golf cart, and one or more processing circuits including one or more memory devices coupled to the one or more processors. The one or more memory devices are configured to store instructions thereon that, when executed by the one or more processors, cause the one or more processors to: determine, based on one or more first signals from the one or more sensors, that a golfer has exited the golf cart, determine, based on one or more second signals from the one or more sensors, a current location of the golf cart, determine, based on one or more third signals from the one or more sensors, a golf stroke of the golfer has occurred, determine a relative position of the golfer during the golf stroke to the current location of the golf cart, and determine a shot position of the golfer based on the relative position of the golfer and the current location of the golf cart.

Another embodiment relates to a golf system. The golf system includes a non-transitory computer-readable medium having instructions stored thereon. The instructions, when executed by one or more processors, cause the one or more processors to: determine, based on one or more first signals from the one or more sensors, that a golfer has exited the golf cart, determine, based on one or more second signals from the one or more sensors, a current location of the golf cart, determine, based on one or more third signals from the one or more sensors, a golf stroke of the golfer has occurred, determine, a relative position of the golfer during the golf stroke to the current location of the golf cart, and determine a shot position of the golfer based on the relative position of the golfer and the current location of the golf cart.

Still another embodiment relates to a golf cart. The golf cart includes one or more sensors and one or more processing circuits including one or more memory devices coupled to the one or more processors. The one or more memory devices are configured to store instructions thereon that, when executed by the one or more processors, cause the one or more processors to: determine, based on one or more first signals from the one or more sensors, that a golfer has exited the golf cart, determine, based on one or more second signals from the one or more sensors, a current location of the golf cart, determine, based on one or more third signals from the one or more sensors, a golf stroke of the golfer has occurred, determine a relative position of the golfer during the golf stroke to the current location of the golf cart, and determine a shot position of the golfer based on the relative position of the golfer and the current location of the golf cart.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Overall Vehicle

Figure 1:
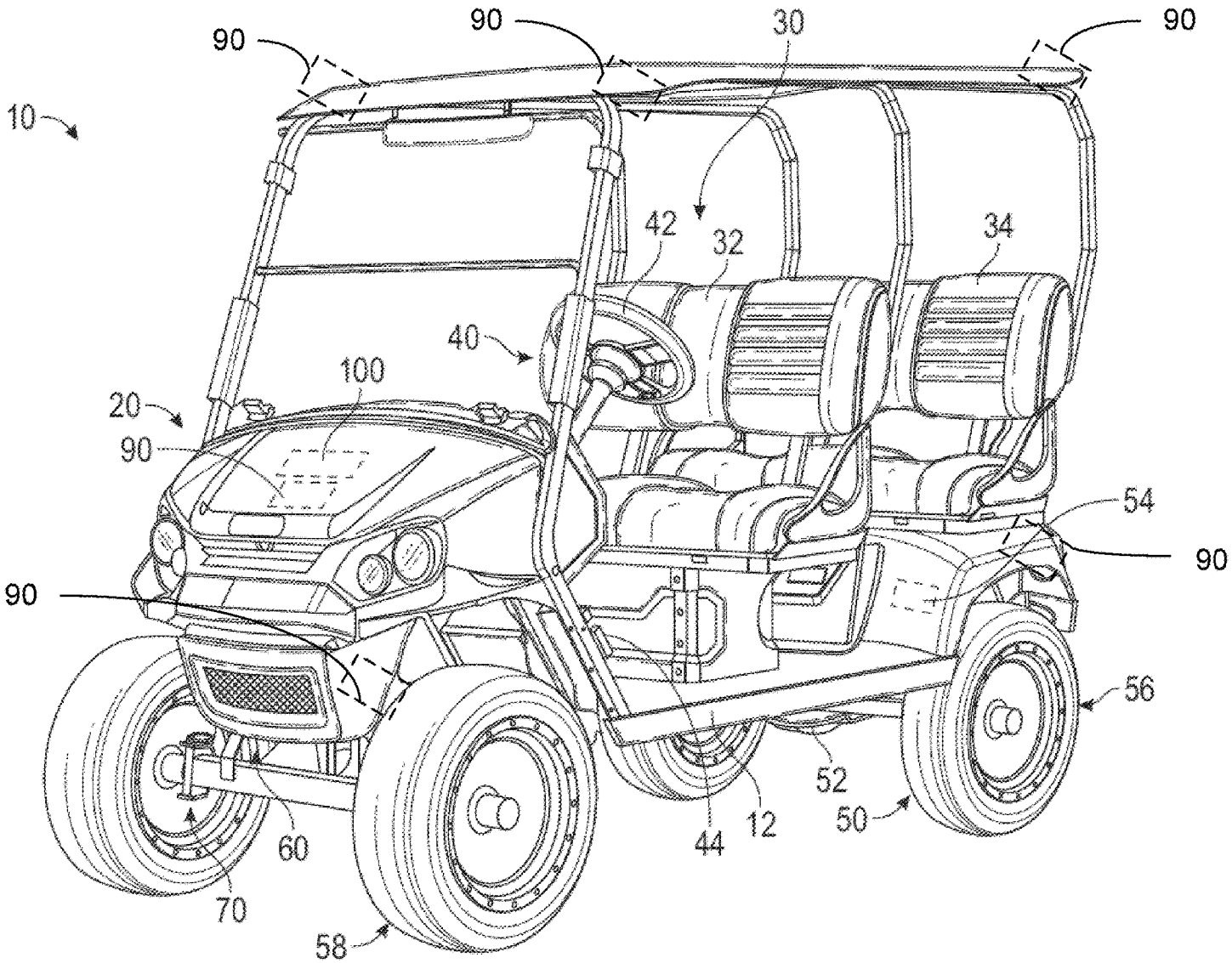
FIG. 1 is a perspective view of a vehicle, according to an exemplary embodiment.
Figure 2:
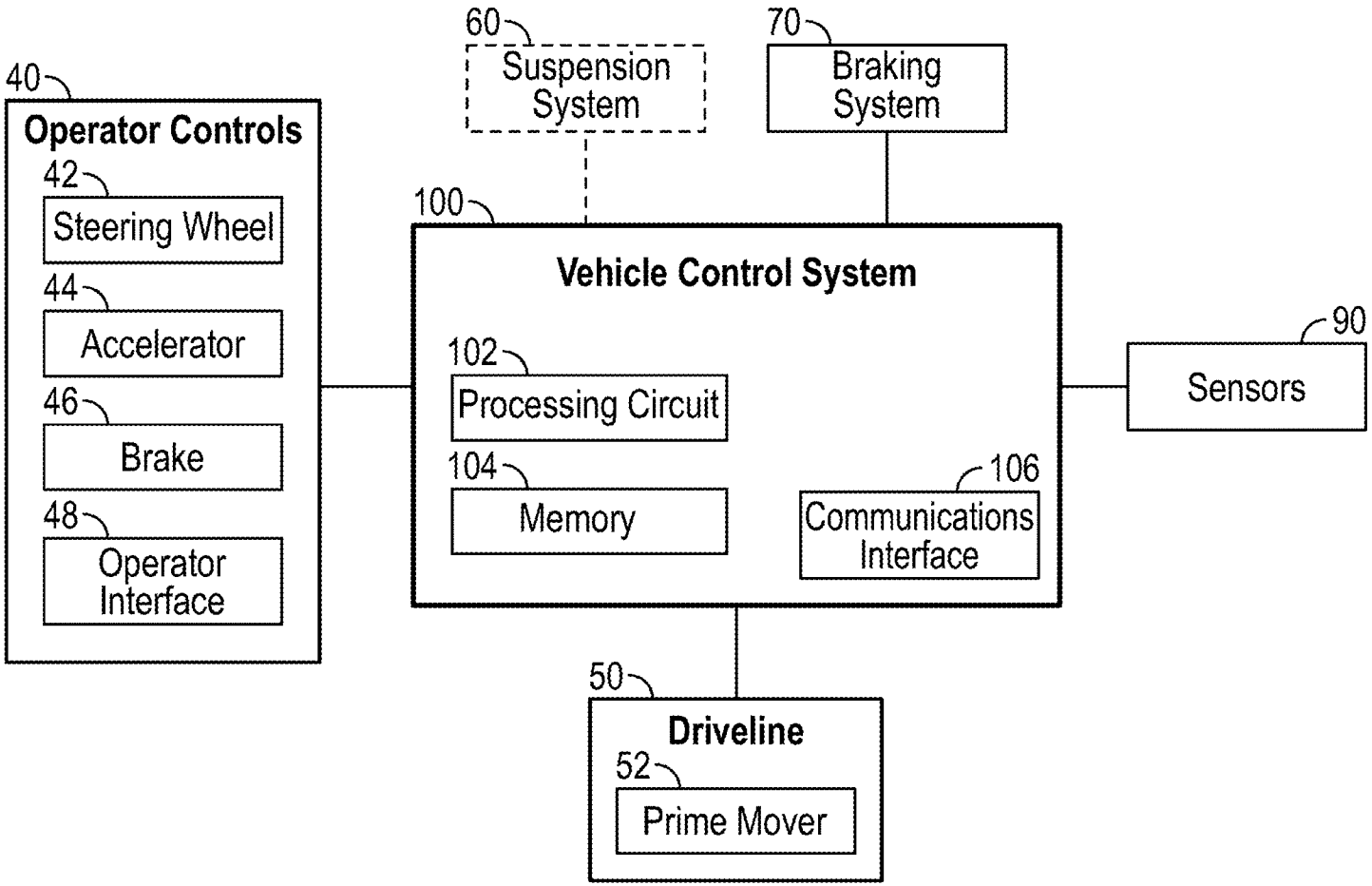
FIG. 2 is a schematic block diagram of the vehicle of FIG. 1, according to an exemplary embodiment.

As shown in FIGS. 1 and 2, a machine or vehicle, shown as vehicle 10, includes a chassis, shown as frame 12; a body assembly, shown as body 20, coupled to the frame 12 and having an occupant portion or section, shown as occupant seating area 30; operator input and output devices, shown as operator controls 40, that are disposed within the occupant seating area 30; a drivetrain, shown as driveline 50, coupled to the frame 12 and at least partially disposed under the body 20; a vehicle suspension system, shown as suspension system 60, coupled to the frame 12 and one or more components of the driveline 50; a vehicle braking system, shown as braking system 70, coupled to one or more components of the driveline 50 to facilitate selectively braking the one or more components of the driveline 50; one or more first sensors, shown as sensors 90; and a control system, shown as vehicle control system 100, coupled to the operator controls 40, the driveline 50, the suspension system 60, the braking system 70, and the sensors 90. In some embodiments, the vehicle 10 includes more or fewer components.

According to an exemplary embodiment, the vehicle 10 is an off-road machine or vehicle. In some embodiments, the off-road machine or vehicle is a lightweight or recreational machine or vehicle such as a golf cart, an all-terrain vehicle ("ATV"), a utility task vehicle ("UTV"), a low speed vehicle ("LSV"), a personal transport vehicle ("PTV"), and/or another type of lightweight or recreational machine or vehicle. In some embodiments, the off-road machine or vehicle is a chore product such as a lawnmower, a turf mower, a push mower, a ride-on mower, a stand-on mower, aerator, turf sprayers, bunker rake, and/or another type of chore product (e.g., that may be used on a golf course).

According to the exemplary embodiment shown in FIG. 1, the occupant seating area 30 includes a plurality of rows of seating including a first row of seating, shown as front row seating 32, and a second row of seating, shown as rear row seating 34. In some embodiments, the occupant seating area 30 includes a third row of seating or intermediate/middle row seating positioned between the front row seating 32 and the rear row seating 34. According to the exemplary embodiment shown in FIG. 1, the rear row seating 34 is facing forward. In some embodiments, the rear row seating 34 is facing rearward. In some embodiments, the occupant seating area 30 does not include the rear row seating 34. In some embodiments, in addition to or in place of the rear row seating 34, the vehicle 10 includes one or more rear accessories. Such rear accessories may include a golf bag rack, a bed, a cargo body (e.g., for a drink cart), and/or other rear accessories.

According to an exemplary embodiment, the operator controls 40 are configured to provide an operator with the ability to control one or more functions of and/or provide commands to the vehicle 10 and the components thereof (e.g., turn on, turn off, drive, turn, brake, engage various operating modes, raise/lower an implement, etc.). As shown in FIGS. 1 and 2, the operator controls 40 include a steering interface (e.g., a steering wheel, joystick(s), etc.), shown steering wheel 42, an accelerator interface (e.g., a pedal, a throttle, etc.), shown as accelerator 44, a braking interface (e.g., a pedal), shown as brake 46, and one or more additional interfaces, shown as operator interface 48. The operator interface 48 may include one or more displays and one or more input devices. The one or more displays may be or include a touchscreen, a LCD display, a LED display, a speedometer, gauges, warning lights, etc. The one or more input device may be or include buttons, switches, knobs, levers, dials, etc.

According to an exemplary embodiment, the driveline 50 is configured to propel the vehicle 10. As shown in FIGS. 1 and 2, the driveline 50 includes a primary driver, shown as prime mover 52, an energy storage device, shown as energy storage 54, a first tractive assembly (e.g., axles, wheels, tracks, differentials, etc.), shown as rear tractive assembly 56, and a second tractive assembly (e.g., axles, wheels, tracks, differentials, etc.), shown as front tractive assembly 58. In some embodiments, the driveline 50 is a conventional driveline whereby the prime mover 52 is an internal combustion engine and the energy storage 54 is a fuel tank. The internal combustion engine may be a spark-ignition internal combustion engine or a compression-ignition internal combustion engine that may use any suitable fuel type (e.g., diesel, ethanol, gasoline, natural gas, propane, etc.). In some embodiments, the driveline 50 is an electric driveline whereby the prime mover 52 is an electric motor and the energy storage 54 is a battery system. In some embodiments, the driveline 50 is a fuel cell electric driveline whereby the prime mover 52 is an electric motor and the energy storage 54 is a fuel cell (e.g., that stores hydrogen, that produces electricity from the hydrogen, etc.). In some embodiments, the driveline 50 is a hybrid driveline whereby (i) the prime mover 52 includes an internal combustion engine and an electric motor/generator and (ii) the energy storage 54 includes a fuel tank and/or a battery system. According to the exemplary embodiment shown in FIG. 1, the rear tractive assembly 56 includes rear tractive elements and the front tractive assembly 58 includes front tractive elements that are configured as wheels. In some embodiments, the rear tractive elements and/or the front tractive elements are configured as tracks.

According to an exemplary embodiment, the prime mover 52 is configured to provide power to drive the rear tractive assembly 56 and/or the front tractive assembly 58 (e.g., to provide front-wheel drive, rear-wheel drive, four-wheel drive, and/or all-wheel drive operations). In some embodiments, the driveline 50 includes a transmission device (e.g., a gearbox, a continuous variable transmission ("CVT"), etc.) positioned between (a) the prime mover 52 and (b) the rear tractive assembly 56 and/or the front tractive assembly 58. The rear tractive assembly 56 and/or the front tractive assembly 58 may include a drive shaft, a differential, and/or an axle. In some embodiments, the rear tractive assembly 56 and/or the front tractive assembly 58 include two axles or a tandem axle arrangement. In some embodiments, the rear tractive assembly 56 and/or the front tractive assembly 58 are steerable (e.g., using the steering wheel 42). In some embodiments, both the rear tractive assembly 56 and the front tractive assembly 58 are fixed and not steerable (e.g., employ skid steer operations).

In some embodiments, the driveline 50 includes a plurality of prime movers 52. By way of example, the driveline 50 may include a first prime mover 52 that drives the rear tractive assembly 56 and a second prime mover 52 that drives the front tractive assembly 58. By way of another example, the driveline 50 may include a first prime mover 52 that drives a first one of the front tractive elements, a second prime mover 52 that drives a second one of the front tractive elements, a third prime mover 52 that drives a first one of the rear tractive elements, and/or a fourth prime mover 52 that drives a second one of the rear tractive elements. By way of still another example, the driveline 50 may include a first prime mover 52 that drives the front tractive assembly 58, a second prime mover 52 that drives a first one of the rear tractive elements, and a third prime mover 52 that drives a second one of the rear tractive elements. By way of yet another example, the driveline 50 may include a first prime mover 52 that drives the rear tractive assembly 56, a second prime mover 52 that drives a first one of the front tractive elements, and a third prime mover 52 that drives a second one of the front tractive elements.

According to an exemplary embodiment, the suspension system 60 includes one or more suspension components (e.g., shocks, dampers, springs, etc.) positioned between the frame 12 and one or more components (e.g., tractive elements, axles, etc.) of the rear tractive assembly 56 and/or the front tractive assembly 58. In some embodiments, the vehicle 10 does not include the suspension system 60.

According to an exemplary embodiment, the braking system 70 includes one or more braking components (e.g., disc brakes, drum brakes, in-board brakes, axle brakes, etc.) positioned to facilitate selectively braking one or more components of the driveline 50. In some embodiments, the one or more braking components include (i) one or more front braking components positioned to facilitate braking one or more components of the front tractive assembly 58 (e.g., the front axle, the front tractive elements, etc.) and (ii) one or more rear braking components positioned to facilitate braking one or more components of the rear tractive assembly 56 (e.g., the rear axle, the rear tractive elements, etc.). In some embodiments, the one or more braking components include only the one or more front braking components. In some embodiments, the one or more braking components include only the one or more rear braking components. In some embodiments, the one or more front braking components include two front braking components, one positioned to facilitate braking each of the front tractive elements. In some embodiments, the one or more rear braking components include two rear braking components, one positioned to facilitate braking each of the rear tractive elements.

The sensors 90 may include various sensors positioned about the vehicle 10 to acquire vehicle information or vehicle data regarding operation of the vehicle 10 and/or the location thereof. By way of example, the sensors 90 may include an accelerometer, a gyroscope, a compass, a position sensor (e.g., a GPS sensor, etc.), an inertial measurement unit ("IMU"), suspension sensor(s), wheel sensors, an audio sensor or microphone, a camera, an optical sensor, a proximity detection sensor, and/or other sensors to facilitate acquiring vehicle information or vehicle data regarding operation of the vehicle 10 and/or the location thereof. According to an exemplary embodiment, one or more of the sensors 90 are configured to facilitate detecting and obtaining vehicle telemetry data including position of the vehicle 10, whether the vehicle 10 is moving, travel direction of the vehicle 10, slope of the vehicle 10, speed of the vehicle 10, vibrations experienced by the vehicle 10, sounds proximate the vehicle 10, suspension travel of components of the suspension system 60, and/or other vehicle telemetry data.

The vehicle control system 100 may be implemented as a general-purpose processor, an application specific integrated circuit ("ASIC"), one or more field programmable gate arrays ("FPGAs"), a digital-signal-processor ("DSP"), circuits containing one or more processing components, circuitry for supporting a microprocessor, a group of processing components, or other suitable electronic processing components. According to the exemplary embodiment shown in FIG. 2, the vehicle control system 100 includes a processing circuit 102, a memory 104, and a communications interface 106. The processing circuit 102 may include an ASIC, one or more FPGAs, a DSP, circuits containing one or more processing components, circuitry for supporting a microprocessor, a group of processing components, or other suitable electronic processing components. In some embodiments, the processing circuit 102 is configured to execute computer code stored in the memory 104 to facilitate the activities described herein. The memory 104 may be any volatile or non-volatile or non-transitory computer-readable storage medium capable of storing data or computer code relating to the activities described herein. According to an exemplary embodiment, the memory 104 includes computer code modules (e.g., executable code, object code, source code, script code, machine code, etc.) configured for execution by the processing circuit 102. In some embodiments, the vehicle control system 100 may represent a collection of processing devices. In such cases, the processing circuit 102 represents the collective processors of the devices, and the memory 104 represents the collective storage devices of the devices.

In one embodiment, the vehicle control system 100 is configured to selectively engage, selectively disengage, control, or otherwise communicate with components of the vehicle 10 (e.g., via the communications interface 106, a controller area network ("CAN") bus, etc.). According to an exemplary embodiment, the vehicle control system 100 is coupled to (e.g., communicably coupled to) components of the operator controls 40 (e.g., the steering wheel 42, the accelerator 44, the brake 46, the operator interface 48, etc.), components of the driveline 50 (e.g., the prime mover 52), components of the braking system 70, and the sensors 90. By way of example, the vehicle control system 100 may send and receive signals (e.g., control signals, location signals, etc.) with the components of the operator controls 40, the components of the driveline 50, the components of the braking system 70, the sensors 90, and/or remote systems or devices (via the communications interface 106 as described in greater detail herein).

Site Monitoring and Control System

Figure 3:
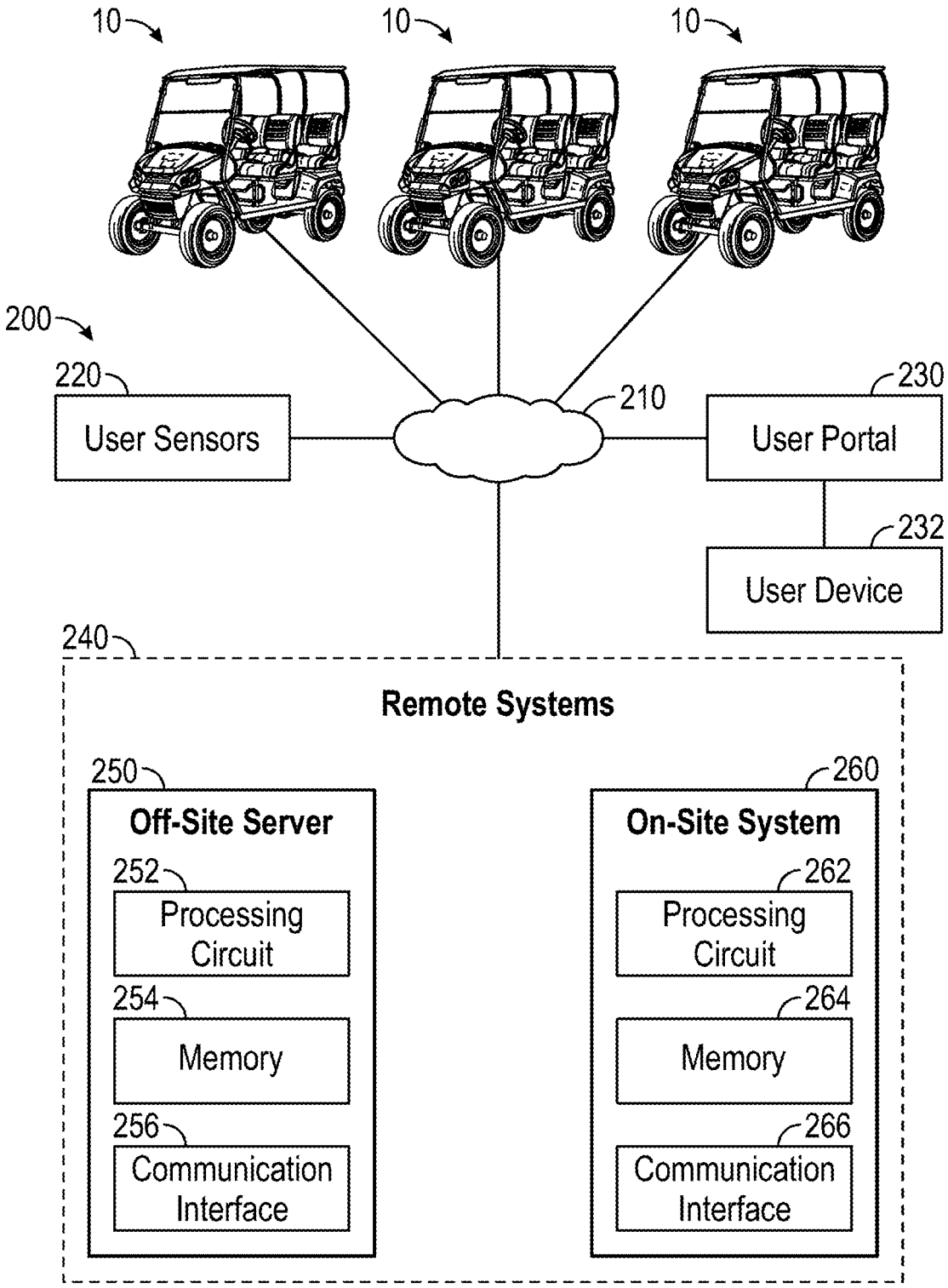
FIG. 3 is a schematic block diagram of a site monitoring and control system including a plurality of the vehicles of FIG. 1, according to an exemplary embodiment.

As shown in FIG. 3, a monitoring and control system, shown as site monitoring and control system 200, includes one or more vehicles 10; one or more second sensors, shown as user sensors 220, positioned remote or separate from the vehicles 10; an operator interface, shown as user portal 230, positioned remote or separate from the vehicles 10; an external or remote user device, shown as user device 232, positioned remote or separate from the vehicles 10; and one or more external processing systems, shown as remote systems 240, positioned remote or separate from the vehicles 10. The vehicles 10, the user sensors 220, the user portal 230, and the remote systems 240 communicate via one or more communications protocols (e.g., Bluetooth, Wi-Fi, cellular, radio, through the Internet, etc.) through a network, shown as communications network 210.

The user sensors 220 may be or include one or more sensors that are carried by or worn by an operator of one of the vehicles 10. By way of example, the user sensors 220 may be or include a wearable sensor (e.g., a smartwatch, a fitness tracker, a pedometer, heart rate monitor, etc.) and/or a sensor that is otherwise carried by the operator (e.g., a smartphone, etc.) that facilitates acquiring and monitoring operator data (e.g., physiological conditions such a temperature, heartrate, breathing patterns, etc.; location; movement; etc.) regarding the operator. The user sensors 220 may communicate directly with the vehicles 10, directly with the remote systems 240, and/or indirectly with the remote systems 240 (e.g., through the vehicles 10 as an intermediary).

The user portal 230 may be configured to facilitate operator access to dashboards including the vehicle data, the operator data, information available at the remote systems 240, etc. to manage and operate the site (e.g., golf course) such as for advanced scheduling purposes, to identify persons braking course guidelines or rules, to monitor locations of the vehicles 10, etc. The user portal 230 may also be configured to facilitate operator implementation of configurations and/or parameters for the vehicles 10 and/or the site (e.g., setting speed limits, setting geofences, etc.). As shown in FIG. 3, the user portal 230 is accessible via the user device 232. The user device 232 may be or include a computer, laptop, smartphone, tablet, or the like. The user portal 230 and the user device 232 may communicate via one or more communications protocols (e.g., Bluetooth, Wi-Fi, cellular, radio, through the Internet, wired connection, etc.) through a network (e.g., a CAN bus, the communications network 210, etc.). The user device 232 includes a display (e.g., a screen, etc.) configured to display one or more graphical user interfaces ("GUIs") of the user portal 230.

As shown in FIG. 3, the remote systems 240 include a first remote system, shown as off-site server 250, and a second remote system, shown as on-site system 260 (e.g., in a clubhouse of a golf course, on the golf course, etc.). In some embodiments, the remote systems 240 include only one of the off-site server 250 or the on-site system 260. As shown in FIG. 3, (a) the off-site server 250 includes a processing circuit 252, a memory 254, and a communications interface 256 and (b) the on-site system 260 includes a processing circuit 262, a memory 264, and a communications interface 266.

According to an exemplary embodiment, the remote systems 240 (e.g., the off-site server 250 and/or the on-site system 260) are configured to communicate with the vehicles 10 and/or the user sensors 220 via the communications network 210. By way of example, the remote systems 240 may receive the vehicle data from the vehicles 10 and/or the operator data from the user sensors 220. The remote systems 240 may be configured to perform back-end processing of the vehicle data and/or the operator data. The remote systems 240 may be configured to monitor various global positioning system ("GPS") information and/or real-time kinematics ("RTK") information (e.g., position/location, speed, direction of travel, geofence related information, etc.) regarding the vehicles 10 and/or the user sensors 220. The remote systems 240 may be configured to transmit information, data, commands, and/or instructions to the vehicles 10. By way of example, the remote systems 240 may be configured to transmit GPS data and/or RTK data based on the GPS information and/or RTK information to the vehicles 10 (e.g., which the vehicle control systems 100 may use to make control decisions). By way of another example, the remote systems 240 may send commands or instructions to the vehicles 10 to implement.

According to an exemplary embodiment, the remote systems 240 (e.g., the off-site server 250 and/or the on-site system 260) are configured to communicate with the user portal 230 via the communications network 210. By way of example, the user portal 230 may facilitate (a) accessing the remote systems 240 to access data regarding the vehicles 10 and/or the operators thereof and/or (b) configuring or setting operating parameters for the vehicles 10 (e.g., geofences, speed limits, times of use, permitted operators, etc.). Such operating parameters may be propagated to the vehicles 10 by the remote systems 240 (e.g., as updates to settings) and/or used for real time control of the vehicles 10 by the remote systems 240.

Golfer Position Estimation

Figure 4:
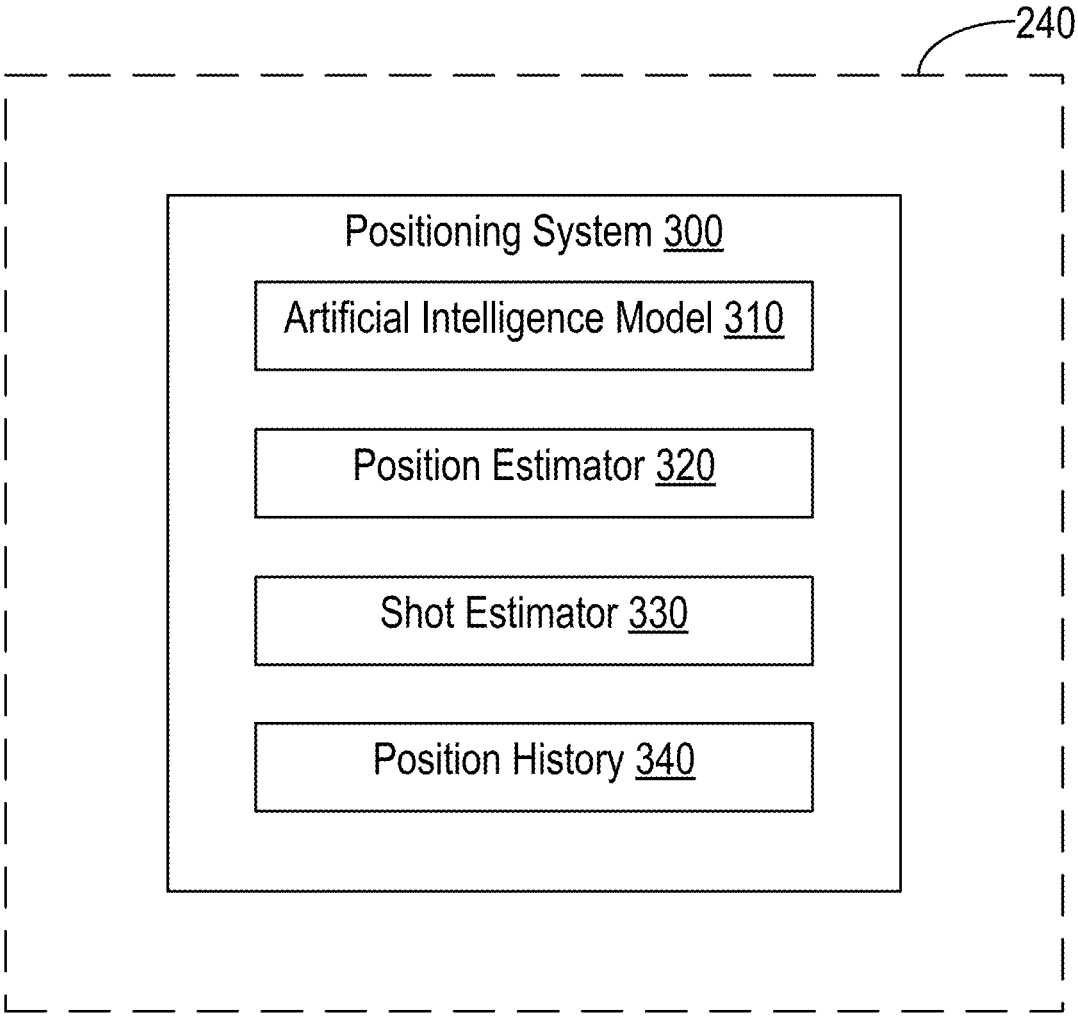
FIG. 4 is a block diagram of a positioning system for estimating golfer position, according to an exemplary embodiment.

Referring now to FIG. 4, a block diagram of a golfer positioning system, shown as positioning system 300, for estimating golfer position is shown, according to an exemplary embodiment. By way of example, the positioning system 300 may be part of the remote systems 240. In some examples, one or more components of the positioning system 300 may be implemented as edge devices or computers located on the vehicle 10.

As shown in FIG. 4, the positioning system 300 includes an artificial intelligence model 310. The artificial intelligence model 310 is or includes any device, component, element, or hardware designed or configured to estimate a position of a golfer relative to the vehicle 10 and estimate a position and distance of a golf shot. In some embodiments, the artificial intelligence model 310 is or includes a neural network and/or machine vision. The artificial intelligence model 310 is communicably coupled to a position estimator 320, a shot estimator 330, and/or a position history 340.

The artificial intelligence model 310 receives sensor data or signals from the sensors 90. For example, the sensors 90 are or include, cameras, LIDAR, inertial measurement units (IMUs), and/or other sensor types. The sensors 90 are positioned on the right, left, back, front, and/or diagonals (e.g., corners) of the vehicle 10. The sensors 90 are configured to detect movements by golfers, golf clubs, and golf balls. For example, the sensors 90 may begin sensing and transmitting sensor data upon identification that a golfer has exited the vehicle 10 (e.g., and is approaching the course to swing a golf club and hit a golf ball). The sensors 90 are also used to determine a current location of the vehicle 10. For example, the sensors 90 may be GPS sensors configured to determine a location of the vehicle 10 in real time. In some embodiments, the sensors 90 continuously obtain sensor data while the golf cart is in use.

In various embodiments, the sensors 90 continuously transmit sensor data to the artificial intelligence model 310. The artificial intelligence model 310 receives the data from the sensors 90 and processes the data continuously and in real time or substantially real time. For example, the computer vision models and/or neural networks of the artificial intelligence model 310 may process the sensor data to determine, detect, and/or identify movements of the golfer, the golf club, and/or the golf ball. Specifically, the artificial intelligence model 310 processes the sensor data to detect that the golfer has exited the vehicle 10 and entered the golf course to hit the golf ball. The artificial intelligence model 310 may receive sensor data indicating a distance between the golfer and the vehicle 10 to identify a position of the golfer relative to the vehicle 10 (e.g., a relative distance).

The position estimator 320 is or includes any device, component, element, or hardware designed or configured to estimate a position of the golfer while on the golf course. In some embodiments, the position estimator 320 includes a computer vision model and/or a neural network. The position estimator 320 is communicably coupled to the artificial intelligence model 310, the shot estimator 330, and/or the position history 340.

The position estimator 320 determines a position or pose of the golfer and classifies the position or pose of the golfer as a golf stroke (e.g., the position estimator 320 determines that the golfer is in a position where he/she hits the golf ball). For example, the artificial intelligence model 310 may detect that the golfer has exited the golf cart, and the position estimator 320 may responsively process future sensor data received from the sensors 90 to detect movements and/or positions of the golfer to determine that the position indicates that the golfer is about to, is currently hitting the golf ball, or has hit the golf ball. The position estimator 320 detects that the golfer's body (e.g., hips, shoulders, feet, hand, arms, etc.) are positioned in a way that indicates that a golf strike is about to occur. For example, the golfer may be holding the golf club and may have their hips and shoulders square to the golf club, which the position estimator 320 may identify and use to determine that the golfer is about to swing the club. In some embodiments, the position estimator 320 determines that the golfer is about to or is swinging the golf club/hitting the golf ball based on an amount of time spent over the golf ball. For example, the position estimator 320 may identify a location of the golf ball and a location of the golfer. The position estimator 320 may classify the golfer's position as indicative of a shot when the golfer has been in the same or a substantially similar pose for above a threshold time (e.g., 10 seconds, 15 seconds, 30 seconds, etc.).

The position estimator 320 also detects that the golfer is currently swinging the golf club and that the golfer has completed a golf swing. For example, the position estimator 320 may identify the movement of the golf club and the movement of the golfer (e.g., shoulders, arms moving) that indicate that a swing is occurring and has subsequently been completed. The shot estimator 330 may combine the relative distance with the GPS position data received from the sensors 90 to estimate the position of the golfer. Once the position estimator 320 has determined that the golfer has made a shot, the position estimator 320 marks or otherwise indicates that a shot has been made.

The position estimator 320 is trained and/or tuned to determine a difference between actual golf strokes, practice strokes, multiple strokes, etc. For example, the neural network of the position estimator 320 may be trained to detect that the golfer has taken multiple swings at the same location and classify only the last swing as an actual stroke.

The position estimator 320 also estimates a golfer position on the golf course when the golfer is not taking a shot. For example, golfers may be in a wooded area of the golf course to search for a golf ball. The sensors 90 may transmit sensor data to the position estimator 320. The location of the vehicle 10 may be used in combination with the sensor data to identify that the golfers are in the woods. For example, the vehicle 10 may be located on a cart path of the golf course near the wooded area and may sense that the golfers are a distance away from the vehicle 10 that indicates the golfers are in the woods.

The shot estimator 330 is or includes any device, component, element, or hardware designed or configured to estimate a distance and direction of the golfer and one or more shots of the golfer relative to the vehicle 10. In some embodiments, the shot estimator 330 includes a machine vision model and/or a neural network. The shot estimator 330 is communicably coupled to the artificial intelligence model 310, the position estimator 320, and/or the position history 340.

The shot estimator 330 estimates a distance and/or a direction of the golfer and one or more shots taken by the golfer relative to the location of the vehicle 10 For example, the position estimator 320 may determine a distance between the golfer and the vehicle 10 and may also identify that the golfer has taken a shot. The shot estimator 330 may combine the relative distance with the GPS position data received from the sensors 90 to estimate the shot.

The shot estimator 330 further identifies that a golfer has made a shot at a first location. The vehicle 10 may move to a second location and determine that the golfer has exited the vehicle for a second time and made a second swing. The position of the golfer at the first location and the position of the golfer at the second location may be used to determine a distance between the first and second locations to determine a shot distance of the ball.

The position history 340 is or includes any device, component, element, or hardware designed or configured to capture and store a history of shots and golfer positions. In some embodiments, the position history 340 includes a memory or other storage device and/or one or more processors to store previously determined position and shot estimations. The position history 340 is communicably coupled to the artificial intelligence model 310, the position estimator 320, and/or the shot estimator 330.

The position history 340 may receive previous strokes and positions of the golfer. For example, for one golfer, each of the golfer's shots during a game may be tracked, processed, and stored as historical data. The historical data is used in golfer profiles and scoring applications. For example, a golfer profile may be updated to include information indicating an average distance of the golfer's shots on, for example, a game-by-game basis, a hole-by-hole basis, etc. For example, the golfer profile may indicate that a golfer's first shot on hole 7 travels a distance of 300 yards. The position history 340 also indicates average distances of shots for different types of strokes. For example, the position history 340 may be used to indicate that the golfer's drives are an average of 300 yards and an average putt distance is 15 feet.

In various embodiments, the position history data may be displayed to the golfer via the operator interface 48. The position history data may be updated in real-time or substantially real time as the golfer makes shots during a round of golf.

Figure 5:
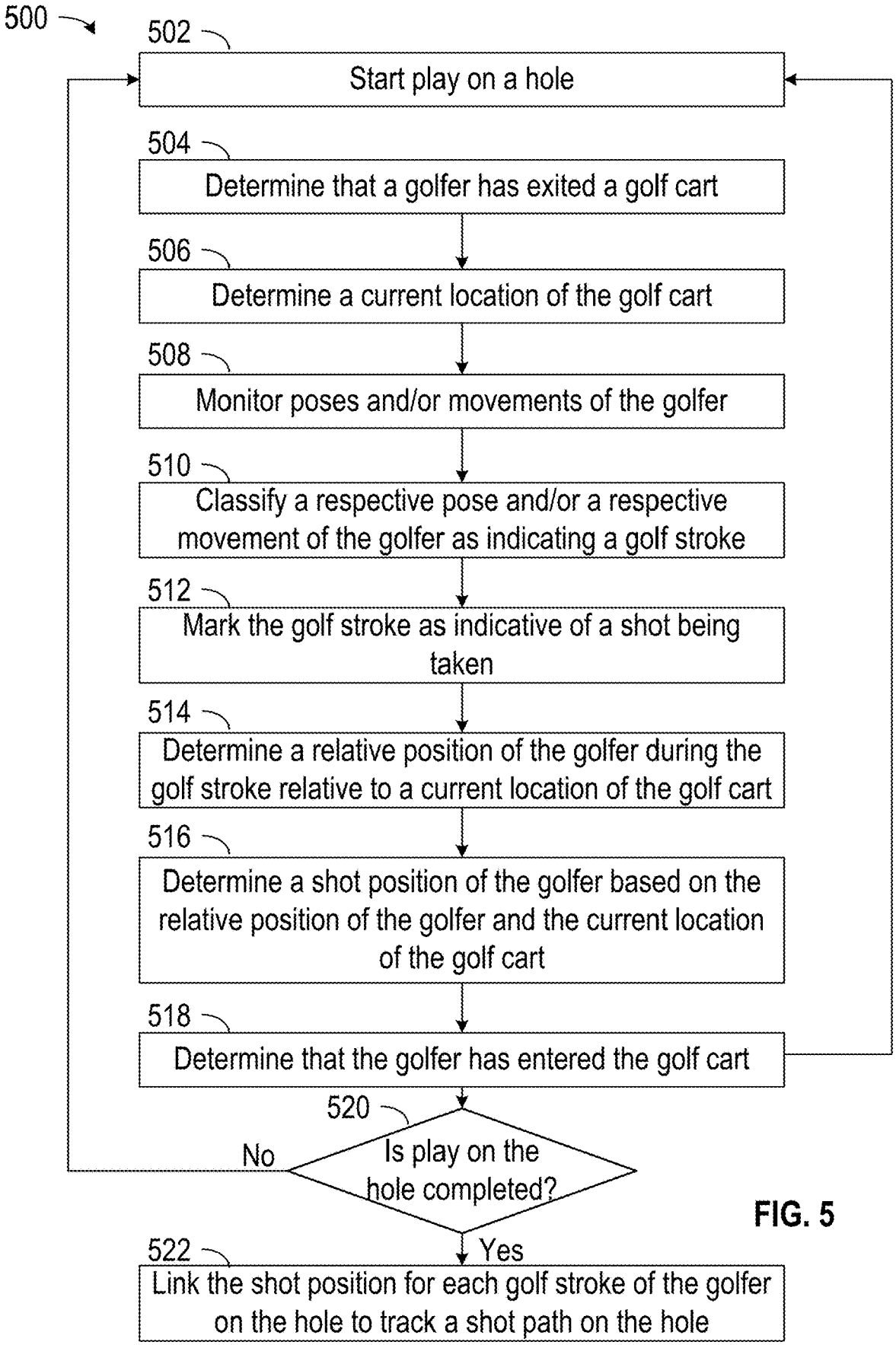
FIG. 5 is a block diagram of a method for estimating golfer positing, according to an exemplary embodiment.

Referring now to FIG. 5, a block diagram for a method 500 for estimating golfer position is shown, according to an exemplary embodiment. One or more golfers may be in or on the vehicle 10 (e.g., a golf cart) to play a round of golf. The method 500 may be executed by a first processing circuit located on the golf cart and/or a second processing circuit located remote from the golf cart.

At step 502, play is started on a hole of the golf course. For example, the golf cart may be positioned at a location near a tee box of a hole indicating that play is starting on the corresponding hole.

At step 504, one or more processing circuits (e.g., of the vehicle controller 100, of the remote systems 240, of the positioning system 300, etc.) determines that the golfer has exited the golf cart. For example, the one or more processing circuits may determine, based on one or more first signals from one or more sensors (e.g., the sensors 90), that a golfer has exited the golf cart. The one or more sensors include at least one of a camera, a lidar sensor, an inertial measurement unit, a proximity sensor, a seat sensor, and/or a global positioning system sensor.

At step 506, the one or more processing circuits determine a current location of the golf cart on the golf course. For example, the one or more processing circuits may determine, based on one or more second signals from the one or more sensors, a current location of the golf cart. The current location of the golf cart may be determined using a global positioning system sensor that facilitates determining the current location of the golf cart.

At step 508, the one or more processing circuits monitor poses and/or movements of the golfer. For example, the one or more processing circuits may monitor, based on one or more third signals from the one or more sensors, at least one of poses or movements of the golfer.

At step 510, the one or more processing circuits classify a respective pose and/or a respective movement of the golfer as indicating a golf stroke. The one or more processing circuits classify at least one of (a) a respective pose of the poses or (b) a respective movement of the movements of the golfer as indicating the golf stroke. Classifying the at least one of the respective pose or the respective movement of the golfer as indicating the golf stroke may be based on an amount of time the golfer is in the respective pose. The one or more processing circuits also determine, based on one or more third signals from the one or more sensors, that a golf stroke of the golfer has occurred.

At step 512, the one or more processing circuits mark the golf stroke as indicative of a shot being taken. In various embodiments, the one or more processing circuits identify one or more golf strokes as practice strokes, and, responsive to identifying a practice stroke, refrains from marking the practice stroke as the shot.

At step 514, the one or more processing circuits determine a relative position of the golfer during the golf stroke relative to a current location of the golf cart. By way of example, based on the one or more third signals, the one or more processing circuits may be configured to determine a relative position of the golfer to the current location of the golf cart.

At step 516, the one or more processing circuits determine a shot position of the golfer on the golf course based on the relative position of the golfer and the current location of the golf cart.

At step 518, the one or more processing circuits determine that the golfer has entered the golf cart. For example, a golfer may be finished with their shot or shots on the specific hole, and may return to the cart to indicate that their turn has finished. The one or more processing circuits may use data from the sensors 90 to determine that the golfer has entered the golf cart (e.g., similar to step 504).

At step 520, the one or more processing circuits determine whether play on a hole is completed (e.g., the golf cart has moved onto a subsequent hole, left a geofence associated with a green of the current hole, etc.). Responsive to a determination that play on the hole is not completed, the method 500 returns to step 504 for each subsequent stroke on the hole. For example, a player may not be finished playing a hole and may reenter the golf cart (e.g., at step 518), and then drive the golf cart to a subsequent stroke on the hole. Play may be determined to not be completed based on, for example, a determination that the golf cart does not begin moving away from its current location and/or moves to a different location on the same hole. At step 520, a determination that play on the hole is completed is made based on a determination that the golf cart is moving from an area corresponding to a first hole to an area corresponding to a second hole (e.g., existing a green geofence of the first hole, entering a tee box geofence of the second hole, machine vision detecting movement away from the first hole toward the second hole, etc.).

At step 522, the one or more processing circuits link the shot position for each golf stroke of the golfer on the hole to track a shot path on the hole. The method 500 may further include displaying, on a user interface (e.g., the operator interface 48, the user device 232, etc.), the shot position and the current location of the golf cart on a respective hole of a golf course. Further, the method 500 may include capturing a history of golf strokes and shot positions of the golfer, which may be similarly accessible on the user interface.

In various embodiments, the golf stroke is a first golf stroke, the relative position is a first relative position, and the shot position is a first shot position on a respective hole. As such, the method 500 includes determining that the golfer has re-entered the golf cart and then subsequently re-exited the golf cart, determining, based on the one or more third signals from the one or more sensors, a second golf stroke of the golfer has occurred on the respective hole, determining a second relative position of the golfer during the second golf stroke to the current location of the golf cart, and determining a second shot position of the golfer based on the second relative position of the golfer and the current location of the golf cart. Further, the method 500 may include displaying, on a user interface, the first shot position and the second shot position on the respective hole, and displaying, on the user interface, shot data based on the first shot position and the second shot position. The shot data includes a distance between the first shot position and the second shot position.

As utilized herein with respect to numerical ranges, the terms "approximately," "about," "substantially," and similar terms generally mean +/−10% of the disclosed values, unless specified otherwise. As utilized herein with respect to structural features (e.g., to describe shape, size, orientation, direction, relative position, etc.), the terms "approximately," "about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the figures. It should be noted that the orientation of various elements may differ according to other exemplary embodiments, and that such variations are intended to be encompassed by the present disclosure.

The hardware and data processing components used to implement the various processes, operations, illustrative logics, logical blocks, modules, and circuits described in connection with the embodiments disclosed herein may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function. The memory (e.g., memory, memory unit, storage device) may include one or more devices (e.g., RAM, ROM, Flash memory, hard disk storage) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit or the processor) the one or more processes described herein.

The present disclosure contemplates methods, systems, and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the vehicle 10 and the systems and components thereof (e.g., the body 20, the operator controls 40, the driveline 50, the suspension system 60, the braking system 70, the sensors 90, the vehicle control system 100, etc.), the site monitoring and control system 200 (e.g., the remote systems 240, the user portal 230, the user sensors 220, etc.), and the positioning system 300 as shown in the various exemplary embodiments is illustrative only. Additionally, any element disclosed in one embodiment may be incorporated or utilized with any other embodiment disclosed herein.

The invention claimed is:

1. A golf system comprising:

a first sensor configured to couple to a golf cart, the first sensor including at least one of a seat sensor or an inertial measurement unit that facilitates determining that a golfer has exited the golf cart;

a second sensor configured to couple to the golf cart; and one or more processing circuits including one or more memory devices coupled to one or more processors, the one or more memory devices configured to store instructions thereon that, when executed by the one or more processors, cause the one or more processors to:

determine, based on one or more first signals from the first sensor, that a golfer has exited the golf cart;

determine, based on one or more second signals, a current location of the golf cart;

determine, based on one or more third signals from the second sensor, a golf stroke of the golfer has occurred;

determine a relative position of the golfer during the golf stroke to the current location of the golf cart; and determine a shot position of the golfer based on the relative position of the golfer and the current location of the golf cart.

2. The golf system of claim 1, wherein the one or more processing circuits includes at least one of (a) a first processing circuit located on the golf cart or (b) a second processing circuit located remote from the golf cart.

3. The golf system of claim 1, wherein the instructions further cause the one or more processors to:

monitor, based on the one or more third signals from the second sensor, at least one of poses or movements of the golfer;

classify at least one of (a) a respective pose of the poses or (b) a respective movement of the movements of the golfer as indicating the golf stroke; and mark the golf stroke as indicative of a shot being taken.

4. The golf system of claim 3, wherein classifying the at least one of the respective pose or the respective movement of the golfer as indicating the golf stroke is based on an amount of time the golfer is in the respective pose.

5. The golf system of claim 3, wherein the instructions cause the one or more processors to identify one or more golf strokes as practice strokes, and, responsive to identifying a practice stroke, refrain from marking the practice stroke as the shot.

6. The golf system of claim 1, wherein the golf stroke is a first golf stroke, the relative position is a first relative position, and the shot position is a first shot position on a respective hole, and wherein the instructions further cause the one or more processors to:

determine that the golfer has re-entered the golf cart and then subsequently re-exited the golf cart;

determine, based on the one or more third signals from the second sensor, a second golf stroke of the golfer has occurred on the respective hole;

determine a second relative position of the golfer during the second golf stroke to the current location of the golf cart; and determine a second shot position of the golfer based on the second relative position of the golfer and the current location of the golf cart.

7. The golf system of claim 6, wherein the instructions cause the one or more processors to link the first shot position to the second shot position to track a shot path of the golfer on the respective hole.

8. The golf system of claim 6, wherein the instructions cause the one or more processors to display, on a user interface, the first shot position and the second shot position on the respective hole.

9. The golf system of claim 6, wherein the instructions cause the one or more processors to display, on a user interface, shot data based on the first shot position and the second shot position.

10. The golf system of claim 9, wherein the shot data includes a distance between the first shot position and the second shot position.

11. The golf system of claim 1, wherein the instructions cause the one or more processors to display, on a user interface, the shot position and the current location of the golf cart on a respective hole of a golf course.

12. The golf system of claim 1, wherein the instructions cause the one or more processors to capture a history of golf strokes and shot positions of the golfer.

13. The golf system of claim 1, wherein the second sensor includes at least one of a camera or a lidar sensor.

14. The golf system of claim 1, further comprising a global positioning system sensor that facilitates determining the current location of the golf cart.

15. The golf system of claim 1, wherein the second sensor includes at least one of a camera, a lidar sensor, or a proximity sensor that facilitates determining the golf stroke of the golfer has occurred and the relative position of the golfer.

16. A golf system comprising:

a non-transitory computer-readable medium having instructions stored thereon that, when executed by one or more processors, cause the one or more processors to:

determine, based on one or more first signals from one or more sensors, that a golfer has exited a golf cart;

determine, based on one or more second signals from the one or more sensors, a current location of the golf cart;

determine, based on one or more third signals from the one or more sensors, a golf stroke of the golfer has occurred;

determine, a relative position of the golfer during the golf stroke to the current location of the golf cart; and determine a shot position of the golfer based on the relative position of the golfer and the current location of the golf cart;

wherein the instructions cause the one or more processors to at least one of:

(a) identify one or more golf strokes as practice strokes, and, responsive to identifying a practice stroke, refrain from marking the practice stroke as indicative of a shot being taken; or (b) classify a respective pose of the golfer as indicating the golf stroke has occurred based on an amount of time the golfer is in the respective pose.

17. The golf system of claim 16, wherein the one or more first signals are acquired by a first sensor and the one or more third signals are acquired by a second sensor different from the first sensor.

18. The golf system of claim 16, wherein the golf stroke is a first golf stroke, the relative position is a first relative position, and the shot position is a first shot position on a respective hole, and wherein the instructions further cause the one or more processors to:

determine that the golfer has re-entered the golf cart and then subsequently re-exited the golf cart;

determine, based on the one or more third signals from the one or more sensors, a second golf stroke of the golfer has occurred on the respective hole;

determine a second relative position of the golfer during the second golf stroke to the current location of the golf cart;

determine a second shot position of the golfer based on the second relative position of the golfer and the current location of the golf cart; and link the first shot position to the second shot position to track a shot path of the golfer on the respective hole.

19. A golf cart comprising:

one or more first sensors including at least one of an inertial measurement unit, a proximity sensor, or a seat sensor;

one or more second sensors including at least one of a camera or a lidar sensor; and one or more processing circuits including one or more memory devices coupled to one or more processors, the one or more memory devices configured to store instructions thereon that, when executed by the one or more processors, cause the one or more processors to:

determine, based on one or more first signals from the one or more first sensors, that a golfer has exited the golf cart;

determine, based on one or more second signals, a current location of the golf cart on a golf course;

determine, based on one or more third signals from the one or more second sensors, a relative position of the golfer to the current location of the golf cart; and determine a position of the golfer on the golf course based on the relative position of the golfer and the current location of the golf cart.

* * * * *